US006939153B1

(12) United States Patent
Kondas et al.

(10) Patent No.: US 6,939,153 B1
(45) Date of Patent: Sep. 6, 2005

(54) DOUBLE "E" ELECTRICAL DISTRIBUTION BLOCK

(75) Inventors: Shawn J. Kondas, Kendallville, IN (US); Daniel L. Hayes, Kendallville, IN (US)

(73) Assignee: Pent Technologies, Inc., Kendallville, IN (US)

( * ) Notice: Subject to any disclaimer, the term of this patent is extended or adjusted under 35 U.S.C. 154(b) by 0 days.

(21) Appl. No.: 10/846,088

(22) Filed: May 14, 2004

Related U.S. Application Data

(60) Provisional application No. 60/470,560, filed on May 14, 2003.

(51) Int. Cl.[7] ..... H01R 4/60

(52) U.S. Cl. ..... 439/211; 439/215; 439/654; 439/652; 439/638

(58) Field of Search ..... 439/211, 215, 638, 439/652, 654

(56) References Cited

U.S. PATENT DOCUMENTS

| | | | | |
|---|---|---|---|---|
| 5,178,555 | A * | 1/1993 | Kilpatrick et al. | 439/215 |
| 5,186,640 | A * | 2/1993 | McCoy | 439/211 |
| 6,491,535 | B1 * | 12/2002 | Buse | 439/215 |
| 6,605,776 | B1 * | 8/2003 | Laukhuf | 174/48 |
| 6,652,288 | B2 * | 11/2003 | Laukhuf et al. | 439/32 |

* cited by examiner

*Primary Examiner*—Tho D. Ta
(74) *Attorney, Agent, or Firm*—Taylor & Aust, P.C.

(57) ABSTRACT

A power distribution block assembly has a plurality of electrical receptacles and a multi-port electrical power distribution block with at least three like longitudinally aligned connector receiving ports near one block end and at least three like longitudinally aligned additional connector receiving ports near a block end opposite the one block end. An intermediate one of one the ports is adapted to receive a power supply connector and a pair of the ports spanning the intermediate port are adapted to receiving corresponding electrical receptacles to thereby position the power supply connector intermediate and sandwiched between the receptacles. An intermediate one of the additional ports is also adapted to receive a jumper cable connector. A pair of the additional ports spanning the intermediate additional port, are each adapted to receive a corresponding additional electrical receptacle so that the jumper cable connector is located intermediate and sandwiched between the additional receptacles. Each electrical receptacle comprises an elongated electrical duplex receptacle having an electrical connector near one end thereof for mating with an outer one of the connector receiving ports so that there may be two or more duplex receptacles extending in a common direction of elongation from the power distribution block in a cantilevered manner, or there may be two duplex receptacles elongatedly extending in opposite directions from the power distribution block in a cantilevered manner.

21 Claims, 4 Drawing Sheets

DOUBLE "E" ELECTRICAL DISTRIBUTION BLOCK

CROSS REFERENCE TO RELATED APPLICATIONS

This application claims the benefit of U.S. Provisional Patent Application No. 60/470,560, filed May 14, 2003, and entitled MODULAR ELECTRICAL DISTRIBUTION SYSTEM IN A MODULAR WALL PANEL ASSEMBLY.

Other related applications include U.S. patent application Ser. No. 10/845,678, filed on even date herewith, entitled SYSTEM TO PLACE RECEPTACLES AND DISTRIBUTION BLOCKS, and U.S. patent application Ser. No. 10/845,695, filed on even date herewith, entitled JUMPER WITH INTEGRAL RECEPTACLE BRACKET, the entire disclosures of which are specifically incorporated herein by reference.

BACKGROUND OF THE INVENTION

1. Field of the Invention

The present invention relates to power distribution block systems, for example, a power distribution system including a multi-port block for supplying power to a plurality of spaced apart work stations as might be present in a modular furniture environment. Such modular electrical distribution systems are used in a variety of applications including wall panel assemblies within an office environment.

2. Description of the Related Art

Wall panel power distribution systems are typically located near a panel upper or lower edge and within a metal channel or wireway. Frequently, one terminal block is provided for each wall panel and that terminal block receives power by way of one attached power cable and passes power on to another wall panel terminal block by way of a second attached power cable. Electrical receptacles are connected to each terminal block to provide electrical outlets for computers, facsimile machines and other office equipment. Many electrical receptacles have the terminals for coupling the receptacle to the terminal block located behind the receptacle outlet terminals, that is, the sets of terminals are aligned generally perpendicular to the wall surface resulting in an undesirably thick structure. End or edge connectors for electrical receptacles have been suggested, but those electrical receptacles are still aligned transversely with the terminal block housing. In applications where receptacles are desired on both the opposite sides of the wall panel, an unacceptably thick structure may result. In either case, mechanical support for the electrical receptacle is provided by the terminal block.

SUMMARY OF THE INVENTION

The present invention provides a unique compact power distribution block and block mounting scheme for distributing power in a modular environment.

The invention comprises, in one form thereof, a power distribution block assembly including a multi-port electrical power distribution block. The block has an electrically insulative body including a plane of symmetry with like body portions extending away from the plane of symmetry on opposite sides thereof. A plurality of electrical contacts aligned generally parallel to one another are disposed within each body portion and extend away from one another in opposite directions generally perpendicular to the plane of symmetry. Each block body portion includes insulating protective shrouds which partially surrounds the electrical contacts. The contacts and shroud define a plurality of like longitudinally aligned multi-contact connector receiving ports all of which extend from the plane of symmetry by substantially the same distance. The contacts of each port have generally coextensive free ends which are adapted to receive mating electrical contacts of a connector received in the corresponding port. In one embodiment, a block mounting bracket is affixable to and removable from the distribution block body without the need for any tools.

An advantage of the present invention is that distribution blocks and receptacles can be placed in tight spaces previously prohibited by current electrical harness designs.

Another advantage of the present invention is that a center port on any one power distribution block can be used for daisy chaining or as a power entry port connection. This center port power entry eliminates the need to use a receptacle port for power entry and no loss of receptacle count due to power feed connection is experienced.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
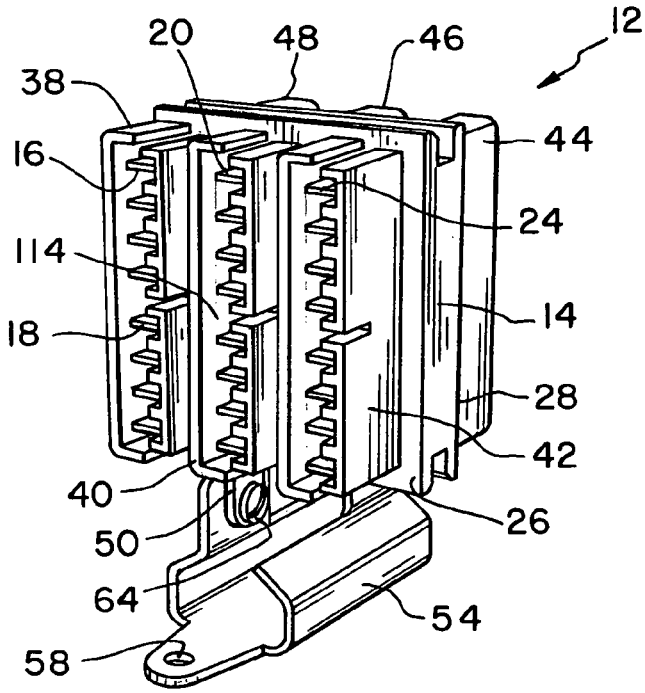
FIG. 1 is an isometric view of a power distribution block and assembled mounting bracket according to the invention in one form.

Referring now to the drawings and particularly to FIG. 1, there is shown a power distribution block 12 suitable for use in a wide variety of applications, especially the modular furniture industry, and particularly in movable wall panels used in modular systems to separate work stations or cubicals. The block 12 includes an insulative body portion 14 surrounding a plurality of electrical contacts such as 16, 18, 20, 22, 24, 108, 110 and 112. The contacts are formed from any suitable conductive somewhat resilient material. Typically, contacts occupying the same relative position such as 16, 20, 24, 108, 110 and 112 are interconnected within the block and may be formed from the same piece of conductive material. The contacts may be male, female or hermaphroditic in gender, and may be any desired combination thereof. In order for the block 12 to mate with a variety of different electrical components in a variety of different configurations, however, it is desirable that like positioned contacts such as 16, 20 and 24 should be all of the same gender. Some of the contacts may be omitted or unused in certain applications.

Figure 2:
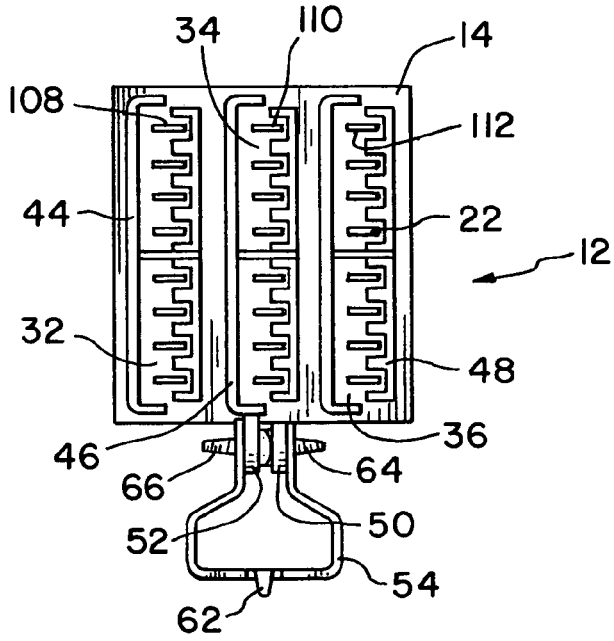
FIG. 2 is an end view of the block and bracket of FIG. 1 from the end not visible in FIG. 1.
Figure 3:
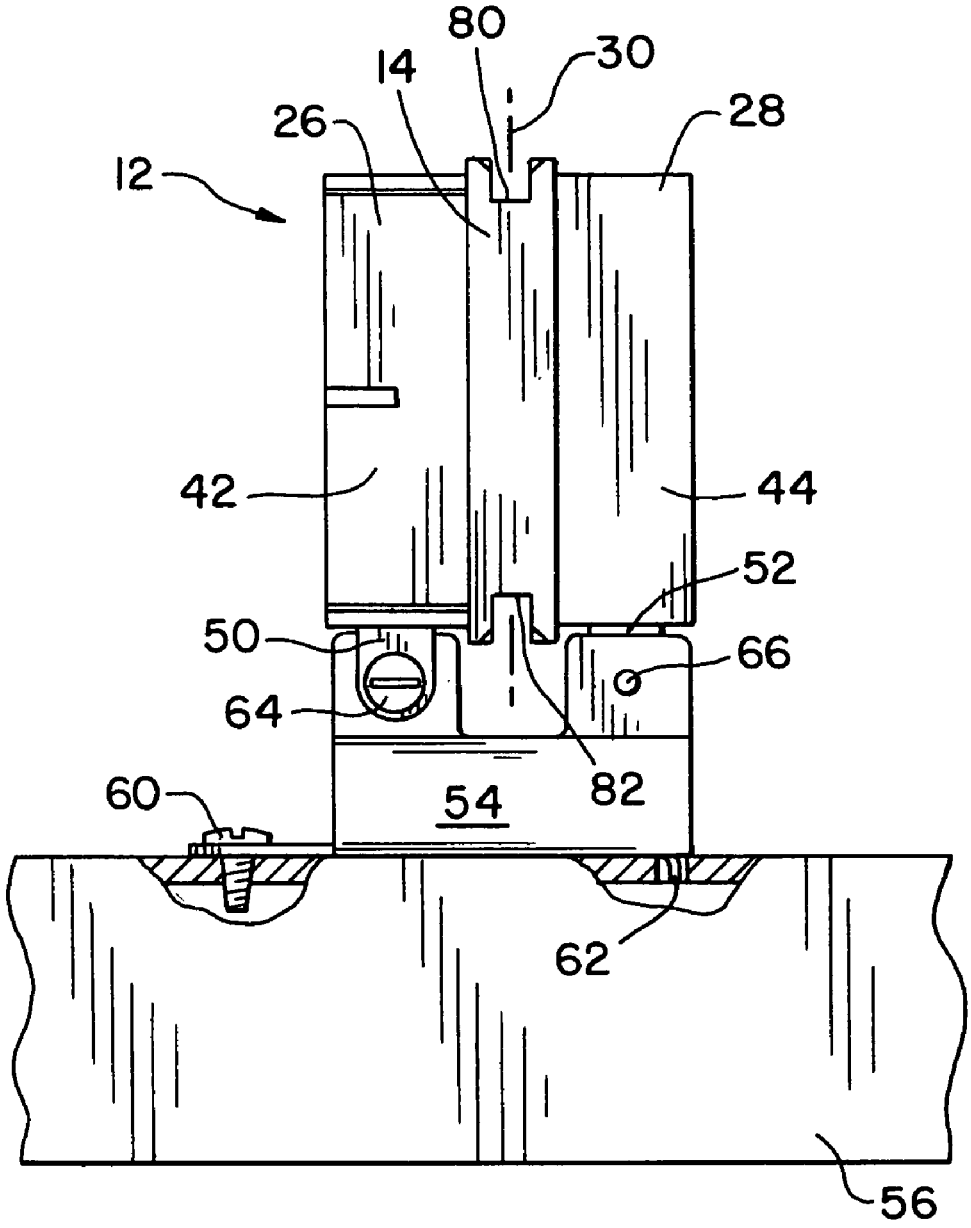
FIG. 3 is a side elevation view of the block and bracket of FIG. 1 assembled to a support member.

Comparing FIGS. 1–3, the block 12 is seen to comprise a pair of like body portions 26 and 28 extending in opposite directions from a plane of symmetry 30 with FIG. 2 being a view perpendicular to plane 30 while FIG. 3 views the edge of the plane. The contacts are arranged in rows and columns as viewed in FIG. 2 with each contact in any given row being electrically connected to every other contact in that row. It will be understood that in some applications, certain of the contacts may be unused or absent. The contact columns comprise contacts for a single connector port with three ports such as 32, 34 and 36 extending in each direction from the plane of symmetry 30. Each port includes an insulative or protective shroud 38, 40, 42, 44, 46 and 48 to prevent accidental electric shocks. The shrouds are shaped to insure any electrical component coupled thereto is connected with the correct polarity, that is, that connection is made with the appropriate contacts. As can be seen in comparing FIGS. 1 and 3–6, the individual contacts or terminals such as 16 have generally coextensive free ends for receiving mating electrical contacts (also having generally coextensive ends) of a connector received in the corresponding port. Their associated shrouds such as 38 are also generally coextensive, that is, extend from the plane of symmetry substantially the same distance. Extending downward from the block 14 are a pair of apertured flanges 50 and 52 which facilitate attachment of the block 14 to a mounting bracket 54.

There are two apertures in the top portion of a fixed structure or support member 56. Mounting bracket 54 includes a threaded fastener receiving aperture 58 (FIG. 1) and is fixed to the support member 56 by a threaded fastener, for example, screw 60 (FIG. 3). The bracket also includes a downwardly bent tab 62 (FIGS. 2 and 3) which engages the other support member aperture to prevent the bracket 54 and distribution block 12 from pivoting about the single screw 60. Such a single screw mounting technique simplifies the process of fastening the bracket 54 to the member 56. The block 14 is fastened to its mounting bracket 54 by screws 64 and 66 which pass through their respective block apertures 50 and 52 and threadedly engage the bracket 54 near the free ends thereof.

Figure 4:
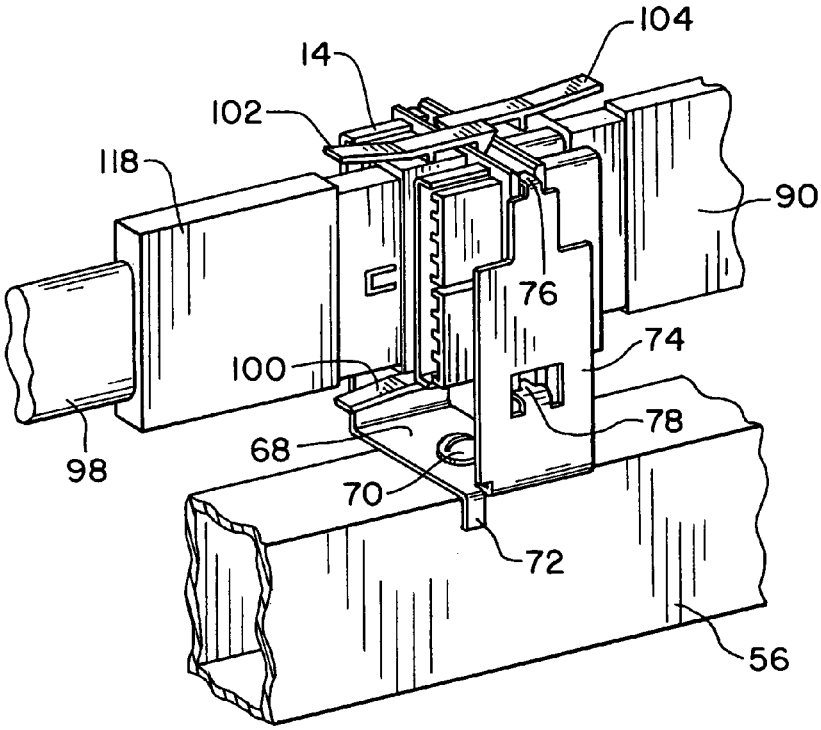
FIG. 4 is an isometric view of the power distribution block of FIG. 1 assembled by a different mounting bracket to a support member.

FIG. 4 illustrates an alternative bracket 68 for attaching the distribution block 14 to the support member 56. Here, the bracket 68 is fixed to the support member by a single screw 70 passing through the central base portion of the bracket and threaded into the upper portion of the member 56. An overhanging tab 77 engages a sidewall of the support member 56 and a similar tab engages the opposite sidewall to prevent rotation of the bracket about the single screw 70. The bracket accepts and releases the distribution block 14 in a tool-less manner. There are a symmetric pair of resilient arms which span lateral sides of the power distribution block body, only one of which 74 is visible in FIG. 4. Each arm has a pair of retaining tabs such as 76 and 78 which engage upper and lower power distribution block surfaces. The engageable upper and lower power distribution block surfaces include retaining tab accepting grooves 80 and 82 which are located one near each of two sides of the block body, extending transversely of the block body and generally in the plane of symmetry 30. Thus, the power distribution block may be mechanically connected to and mechanically disconnected from the mounting bracket in a tool-free manner. For example, the power distribution block 14 may be disconnected from the mounting bracket 68 by moving the arms such as 74 away from one another against the resilient urging until the retaining tabs 76 and 78 disengage from the grooves 80 and 82. The jumper cable connectors 90 and 118 are engaged with ports 114 and 34 respectively. Each jumper cable connector includes a pair of latching pawls 100, 102, 104 and 106. When the connector is coupled to any one of the six illustrated ports, its corresponding pawls engage the block grooves 80 and 82 to ensure that the cable connector is not inadvertently disconnected. Thus, the same grooves function to receive and retain latching pawls as well as the mounting bracket tabs such as 76 and 78.

Figure 5:
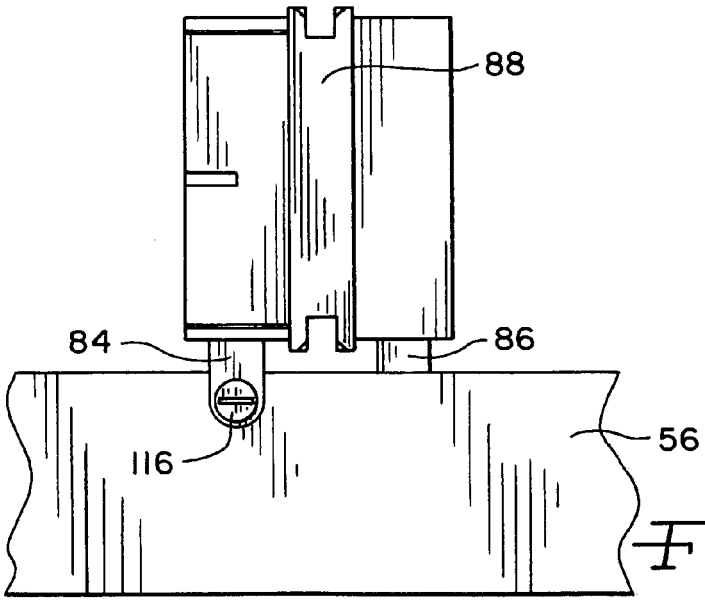
FIG. 5 is a side elevation view of the block of FIG. 1 showing an alternate mounting technique.

Another alternative for fixing the distribution block to the support member is shown in FIG. 5. Here no separate bracket is employed, rather the downwardly extending apertured flanges 50 and 52 of FIGS. 1–3 have been lengthened and displaced laterally outwardly to span opposite sides of the support member 56. These modified apertured flanges 84 and 86 are directly fastened to the support member by a pair of screws such as 116. Distribution block 88 is otherwise like block 14.

Figure 6:
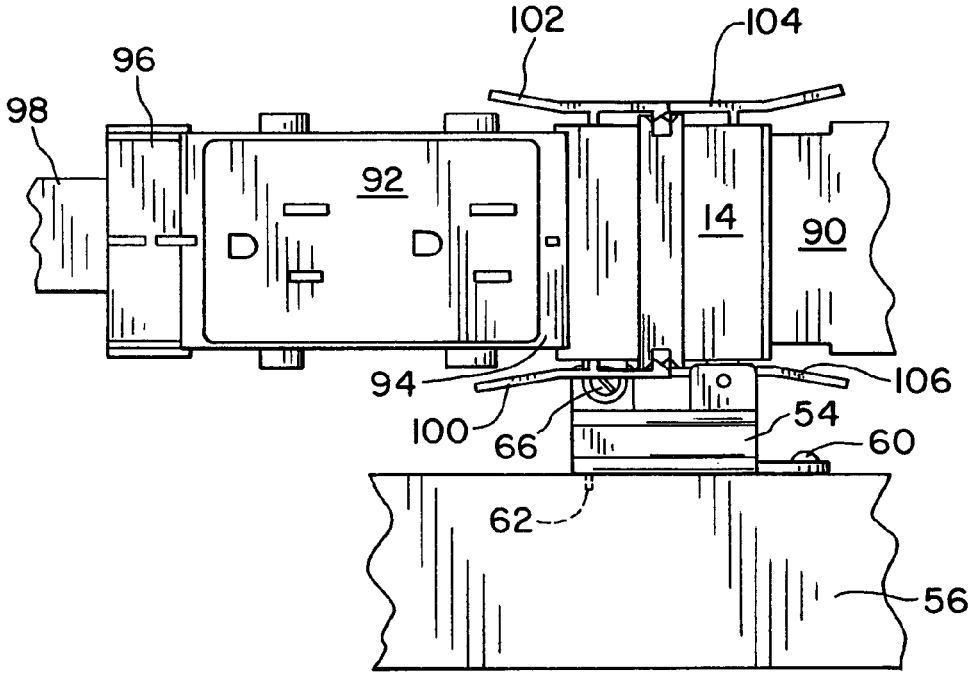
FIG. 6 is a side elevation view of the block and bracket of FIGS. 1–3 assembled with a fixed support member, jumper cables, and an electrical receptacle.

FIGS. 4 and 6 differ only in the type mounting bracket employed and the presence of an electrical receptacle 92. In FIG. 6, the electrical distribution block 14 and mounting bracket 54 are shown assembled to the support member 56, however, the view in FIG. 6 is of the side opposite that of FIG. 3. An electrical connector 90 is mated with the central port 114 associated with shroud 40. A jumper cable 98 having a similar connector (118 of FIG. 4) is connected to the central port 34. One end connector 94 of an electrical component, such as duplex receptacle 92 is electrically joined to the port 36 associated with shroud 48 and obscures the view of the cable 98 connector in FIG. 8. Either one of the jumper cables (but not both) may, for example, function to connect the corresponding distribution block to a power supply. Either one of the jumper cables (or both) may, for example, function to connect the corresponding distribution block to another distribution block or similar electrical component. Note the receptacle 92 extends from the distribution block 14 in a cantilevered manner. Similar electrical receptacles could be electrically coupled to the remaining three outer ports. If an additional receptacle were connected to port 32, the receptacles would span the connector of cable 98, that is the connector would be sandwiched between the cantilevered receptacles yielding a very compact concentration of outlets in a very limited space.

Figure 7:
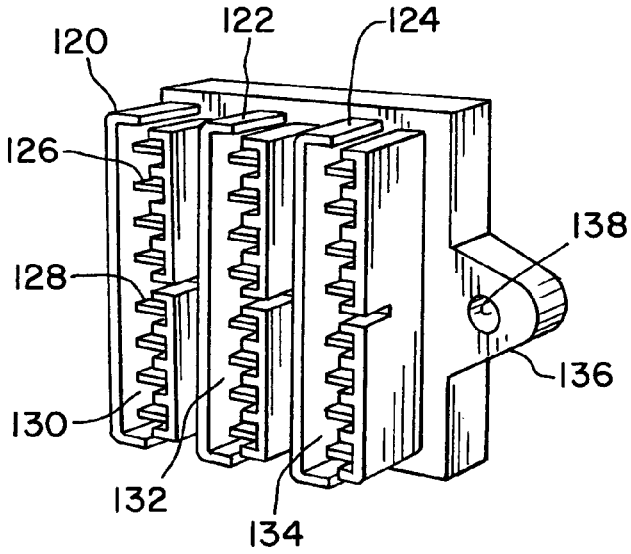
FIG. 7 is an isometric view of power distribution block illustrating the invention in another form.

In FIG. 7, there is shown a variation on the power distribution block. This distribution block includes a protective shroud including a plurality of protective shroud portions 107, 109 and 111 partially surrounding electrical contacts such as 113 and 115 to define a plurality of connector ports 117, 119 and 121. The ports all extend in the same direction and terminate in a common plane. In FIG. 7, the block has only three ports and comprises essentially half of the previously described distribution block. The mounting arrangement for the distribution block of FIG. 7 includes a pair of laterally extending flanges, only one of which, 123, is visible in FIG. 7. Each flange includes a fastener accepting aperture 125 which facilitates attachment of the distribution block to a support member.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

GRD0256 Parts List

12 multi-port electrical power distribution block
14 insulative body
16–24, 108, 110, 112, 126, 128 electrical contacts
26–28 body portions
30 plane of symmetry
32, 34, 36, 114, 130, 132, 134 connector port
38–48 protective shroud
50, 52 apertured flanges
54 power distribution block mounting bracket
56 fixed structure or support member, e.g., wall panel frame or other rigid support
58 threaded fastener receiving aperture
60, 64, 66, 70, 116 threaded fastener (screws)
62 support member engaging tab
68 alternative power distribution mounting bracket
72 overhanging tab
74 resilient arms
76, 78 retaining tabs
80, 82 transverse tab accepting (or retaining) grooves
84, 86 modified apertured flanges
88 alternative distribution block
90, 118 connector, e.g., power supply
92 electrical component, e.g., receptacle (duplex)
94, 96 duplex end connector
100–106 latching pawl
120, 122, 124 protective shroud portions
136 flange
138 flange aperture

What is claimed is:

1. A power distribution block assembly including a multi-port electrical power distribution block comprising:

an electrically insulative body including a plane of symmetry and like body portions extending away from the plane of symmetry on opposite sides thereof;

a plurality of electrical contacts disposed within each body portion extending generally perpendicular to the plane of symmetry and aligned generally parallel to one another;

the body portions each including a protective shroud partially surrounding the electrical contacts, the contacts and shroud defining a plurality of at lease three like longitudinally aligned multi-contact connector receiving ports all extending from the plane of symmetry substantially the same distance; and the contacts of each port having generally coextensive free ends for receiving mating electrical contacts of a connector received in the corresponding port.

2. The power distribution block assembly of claim 1, wherein electrical contacts occupying the same relative position in each port are electrically interconnected.

3. The power distribution block assembly of claim 1, wherein the body portion includes at least one retaining groove extending transversely of the body and generally in the plane of symmetry, the groove positioned to receive the latching pawl of a connector engaging any one of the connector ports.

4. The power distribution block assembly of claim 3, wherein there are two retaining grooves, one near each of two sides of the block extending transversely of the body and generally in the plane of symmetry, the grooves positioned to receive a corresponding pair of latching pawls of a connector engaging any one of the connector ports.

5. The power distribution block assembly of claim 1, further comprising a power distribution block mounting bracket.

6. The power distribution block assembly of claim 5, wherein the body portion includes a pair of laterally extending apertured flanges, each extending from a corresponding one of the body portions; the mounting bracket comprising a generally U-shaped member having a pair of threaded fastener receiving apertures near each free U end alignable with the flange apertures, whereby the power distribution block and block mounting bracket may be joined by a pair of threaded fasteners.

7. The power distribution block assembly of claim 5, wherein the block mounting bracket includes a pair of resilient arms for spanning lateral sides of the power distribution block body, each arm having a pair of retaining tabs for engaging upper and lower power distribution block surfaces, the upper and lower power distribution block surfaces including retaining tab accepting grooves whereby the power distribution block may be mechanically connected to and mechanically disconnected from the mounting bracket in a tool-free manner.

8. The power distribution block assembly of claim 7, wherein the body portion includes two retaining grooves, one near each of two sides of the block body extending transversely of the block body and generally in the plane of symmetry, the grooves positioned to receive a corresponding pair of latching pawls of a connector engaging any one of the connector ports.

9. The power distribution block assembly of claim 7, wherein the two retaining grooves and the retaining tab accepting grooves comprise the same grooves.

10. A power distribution block assembly including a multi-port electrical power distribution block comprising:

an electrically insulative body including a pair of body portions extending in opposite directions away from one another;

a plurality of electrical contacts disposed within each body portion extending generally parallel to one another;

the body portions each including a protective shroud partially surrounding the electrical contacts, the contacts and shroud defining a plurality of like longitudinally aligned multi-contact connector receiving ports;

the contacts of each port having generally coextensive free ends for receiving mating electrical contacts of a connector received in the corresponding port; and a block mounting bracket affixable to and removable from a single side of the block body in a tool-free manner.

11. The power distribution block assembly of claim 10, wherein electrical contacts occupying the same relative position in each port are electrically interconnected.

12. A power distribution block assembly including a multi-port electrical power distribution block comprising:

an electrically insulative body including a pair of body portions extending in opposite directions away from one another;

a plurality of electrical contacts disposed within each body portion extending generally parallel to one another;

the body portions each including a protective shroud partially surrounding the electrical contacts, the contacts and shroud defining a plurality of like longitudinally aligned multi-contact connector receiving ports;

the contacts of each port having generally coextensive free ends for receiving mating electrical contacts of a connector received in the corresponding port; and a block mounting bracket affixable to and removable from the block body in a tool-free manner, wherein the block mounting bracket includes a pair of resilient arms for spanning lateral sides of the power distribution block body, each arm having a pair of retaining tabs for engaging upper and lower power distribution block surfaces, the upper and lower power distribution block surfaces including retaining tab accepting grooves whereby the power distribution block may be disconnected from the mounting bracket by moving the arms away from one another against the resilient urging until the retaining tabs disengage from the grooves.

13. The power distribution block assembly of claim 12, wherein the body portion includes two retaining grooves, one near each of two sides of the block body extending transversely of the block body, the grooves positioned to receive a corresponding pair of latching pawls of a connector engaging any one of the connector ports.

14. The power distribution block assembly of claim 13, wherein the two retaining grooves and the retaining tab accepting grooves comprise the same grooves.

15. The power distribution block assembly of claim 13, wherein there are three like longitudinally aligned multi-contact connector receiving ports extending in each of two opposite directions away from one another resulting in an electrical power distribution block having six like multi-contact connector receiving ports.

16. A power distribution block assembly including a plurality of electrical receptacles and a multi-port electrical power distribution block having at least three like longitudinally aligned connector receiving ports near one block end, an intermediate one of the ports for receiving a power supply connector and a pair of the ports spanning the intermediate port, each for receiving a corresponding electrical receptacle to thereby position the power supply connector intermediate and sandwiched between the receptacles.

17. The power distribution block assembly of claim 16, wherein the multi-port electrical power distribution block further includes at least three like longitudinally aligned additional connector receiving ports near a block end opposite said one block end, an intermediate one of the additional ports for receiving a jumper cable connector and a pair of the additional ports spanning the intermediate additional port, each for receiving a corresponding additional electrical receptacle to thereby position the jumper cable connector intermediate and sandwiched between the additional receptacles.

18. The power distribution block assembly of claim 16, wherein the electrical receptacles each comprises an elongated electrical duplex receptacle having an electrical connector near one end thereof for mating with an outer one of the connector receiving ports whereby the duplex receptacles extend in a common direction of elongation from the power distribution block in a cantilevered manner.

19. The power distribution block assembly of claim 18, wherein the multi-port electrical power distribution block further includes at least three additional like longitudinally aligned connector receiving ports near an end opposite said one block end, and further comprising a third elongated electrical duplex receptacle having an electrical connector near one end thereof for mating with an outer one of the additional connector receiving ports whereby the third duplex receptacle extends in the direction of elongation from the power distribution block opposite end in a cantilevered manner.

20. A power distribution block assembly including a multi-port electrical power distribution block comprising:

an electrically insulative body;

a plurality of electrical contacts disposed within the body aligned and extending generally parallel to one another;

the body portion including a protective shroud partially surrounding the electrical contacts, the contacts and shroud defining a plurality of at lease three like longitudinally aligned multi-contact connector receiving ports all extending in the same direction and terminating in a common plane; and the contacts of each port having generally coextensive free ends for receiving mating electrical contacts of a connector received in the corresponding port.

21. The power distribution block assembly of claim 20, further comprising a pair of flanges extending laterally from opposed sides of the connector body portion, each flange including a fastener accepting aperture for facilitating attachment of the distribution block to a support member.

* * * * *